US005235832A

United States Patent [19]

Lux et al.

[11] Patent Number: 5,235,832

[45] Date of Patent: Aug. 17, 1993

[54] LOCKS AND SWITCH LOCKS HAVING SUBSTITUTABLE PLUG-TYPE OPERATOR ASSEMBLIES

[75] Inventors: Mark S. Lux, Gurnee; Timothy P. Laabs, Des Plaines, both of Ill.

[73] Assignee: The Eastern Company, Wheeling, Ill.

[21] Appl. No.: 644,936

[22] Filed: Jan. 23, 1991

[51] Int. Cl.[5] ..... E05B 29/04

[52] U.S. Cl. ..... 70/368; 70/375; 70/421; 70/DIG. 30

[58] Field of Search ..... 70/367-368, 70/369, DIG. 30, 492, 421, 375; 200/43.08

[56] References Cited

U.S. PATENT DOCUMENTS

| | | | |
|---|---|---|---|
| 1,244,450 | 10/1917 | Christoph | 70/429 |
| 1,244,671 | 10/1917 | Wikheim | 200/43.08 |
| 1,913,963 | 6/1933 | Shinn | 70/368 |
| 1,922,889 | 8/1933 | Falk | 70/368 |
| 1,971,596 | 8/1934 | Brauning | 70/375 |
| 2,007,142 | 7/1935 | Keil | 70/367 |
| 2,019,534 | 11/1935 | Henst | 70/368 |
| 2,061,456 | 11/1936 | Falk | 70/368 |
| 2,097,190 | 10/1937 | Jacobi | 70/368 |
| 2,883,848 | 4/1959 | Wolniak | 70/367 |
| 3,336,774 | 8/1967 | Gray et al. | 70/367 |
| 3,639,708 | 2/1972 | Wolniak et al. | 200/44 |
| 4,405,843 | 9/1983 | Wolniak et al. | 200/44 |
| 4,427,852 | 1/1984 | Wolniak et al. | 200/44 |
| 4,566,167 | 1/1986 | Wolniak et al. | 29/437 |
| 4,633,689 | 1/1987 | Wolniak et al. | 70/379 |
| 4,689,977 | 9/1987 | Wolniak et al. | 70/379 |
| 4,712,400 | 12/1987 | Steinbach | 70/421 X |
| 4,843,852 | 7/1989 | Foshee et al. | 70/375 X |

FOREIGN PATENT DOCUMENTS

| | | | |
|---|---|---|---|
| 3143638 | 5/1983 | Fed. Rep. of Germany | 70/492 |

OTHER PUBLICATIONS

*Illinois Lock Mechanical Line Catalog No. 189*, Copyright 1989, pp. 15 & 16, Illinois Lock Company Division of The Eastern Co., Wheeling, Illinois 60090.

*Mystic Desk Lock*, Form MDL dated Nov. 1984, a two-page brochure, pp. 1 & 2, Illinois Lock Company Division of The Eastern Co., Wheeling, Illinois 60090.

"No. 360 Plug," Plug Retainer & Retainer Spring as shown in Illinois Lock Drawings No. 5C6174 (pp. 1 & 2 of 2), 3053 & SS 3054, respectively, dated not later than Sep. 10, 1981, Illinois Lock Company Division of The Eastern Co., Wheeling, Illinois 60090.

*Primary Examiner*—Lloyd A. Gall

*Attorney, Agent, or Firm*—David A. Burge

[57] ABSTRACT

Substitutable plug assemblies are removably retained at an operating position within a forwardly opening chamber of the barrel of a lock assembly. A plug assembly that has been inserted to the operating position is releasably retained within the enshrouding barrel by a retainer that is moved by spring bias to a plug-retaining position wherein the retainer bridges complementary formations that are defined by the barrel and by the inserted plug assembly. A retained plug assembly that has been inserted to the operating position can be rotated about the central axis relative to the barrel between at least a pair of angularly spaced positions. One of the plug assemblies carries tumblers that are engageable with interior portions of the barrel for locking the one plug assembly in at least one of the angularly spaced positions unless the one plug assembly is unlocked by a suitably configured key. The other of the substitutable plug assemblies preferably includes a manually operable formation such as a knob. In preferred practice, the other of the substitutable plug assemblies includes a manually operable formation such as a knob that permits the lock assembly to be operated without the need for a key. The lock assembly may be combined with an electrical switch to provide a lock controllable switch.

30 Claims, 5 Drawing Sheets

LOCKS AND SWITCH LOCKS HAVING SUBSTITUTABLE PLUG-TYPE OPERATOR ASSEMBLIES

BACKGROUND OF THE INVENTION

1. Field of the Invention

The present invention relates to a lock assembly that has a generally cylindrical barrel into which either of a pair of substitutable plug-type operator assemblies can be inserted for rotation between at least a pair of angularly spaced positions to operate the lock, with at least one of the substitutable plug assemblies being key-operated and including key-operated tumblers for releasably locking the key-operated plug assembly in at least one of the angularly spaced positions, and with a releasable retainer mechanism permitting removal of an inserted plug assembly from the barrel only under controlled conditions. In preferred practice the lock assembly forms a component part of a "switch lock" (i.e., an electrical switch that normally is lock-operated). In preferred practice, the other of the substitutable plug assemblies includes a manually operable formation such as a knob, and, when inserted into the barrel in place of the key-operated plug assembly, permits the lock or switch lock to be operated without the need for a key.

2. Prior Art

Locks are known that have key-receivable plug-type operator assemblies that are retained within protectively enshrouding barrels, and that are operated in response to rotation of the plug assemblies relative to their associated barrels between at least a pair of angularly spaced positions. Likewise, switch locks are known that employ such locks coupled with electrical switch assemblies. Typically, a rear portion of a the barrel of a lock is rigidly connected to the housing of a rotary electrical switch, a rear portion of a key-receivable plug assembly is connected to a rotatable operator of the electrical switch, and switch operation is effected by rotating the plug assembly relative to the barrel between angularly spaced positions to effect corresponding rotation of the switch operator. Examples of switch locks of this general type are disclosed in such patents as U.S. Pat. Nos. 4,689,977, 4,633,689, 4,566,167, 4,427,852, 4,405,843 and 3,639,708 issued to Stanley C. Wolniak et al, referred to hereinafter as the "Switch Lock Patents," the disclosures of which are incorporated herein by reference.

The use of a U-shaped, spring-biased retaining member to fasten a key-receivable plug assembly within a surrounding barrel, with the retainer bridging complementary formations that are defined by the plug assembly and by the surrounding barrel is known. Features of a key-operable lock that employs such a spring-biased retaining mechanism are disclosed in U.S. Pat. No. 2,883,848 issued to Stanley C. Wolniak, referred to hereinafter as the "Permanently Assembled Lock Patent," the disclosure of which is incorporated herein by reference.

The use of a variety of groove-carried retention members that bridge from a groove that is formed in a portion of a key-receivable plug assembly to a complimentary groove that is formed in a surrounding portion of a barrel to fasten the plug assembly in the barrel is well known. In the above-referenced Permanently Assembled Lock Patent, such complementary grooves are provided near the rear end region of the plug assembly (i.e., complementary grooves carry a bridging retainer at a location that is spaced a substantial distance rearwardly from an enlarged diameter head formation that typically is provided near the front end region of the plug assembly). In some of the invention embodiments that are disclosed in the referenced Switch Lock Patents (e.g., in U.S. Pat. Nos. 4,566,167, 4,427,852 and 4,405,843), such complementary grooves are formed in peripheral surfaces of enlarged diameter head formations of the plug assemblies, and in surrounding barrel portions (i.e., complementary grooves carry retainers at locations that are near the front ends of the plug assemblies).

A variety of proposals have been made in efforts to provide relatively simple methods and/or means for permitting key-operable plug assemblies to be removed from the surrounding barrels of relatively high security locks and switch locks for maintenance and/or to enable the plug assemblies to be replaced with substitute plug assemblies. However, to the extent that it has been possible to carry out such proposals by accessing only the front-most portions of an installed high security lock or switch lock (i.e., by accessing only such portions of the installed lock or switch lock as normally are accessible), such proposals typically have required the use of are referred to as "control" keys (i.e., keys that differ in configuration from such "change" keys and "master" keys as may be used on a day-to-day basis to operate the locks and switch locks). In many instances, the need to configure the tumblers of relatively high security locks and switch locks to respond to the insertion of any of a plurality of differently configured keys results in a dramatic decrease in the resistance that the lock or switch lock offers to being picked, drilled, forced or otherwise defeated. Stated in another way, a drawback that is common to many prior proposals for modifying relatively high security locks and switch locks to enable their plug assemblies to be releasably retained within and removed from their associated barrels is that the implementation of these proposals has significantly diminished the level of security that otherwise would be provided by the locks and switch locks.

Various other proposals (i.e., proposals that do not utilize "control" keys and that arguably may not result in dramatic reductions of the level of security that otherwise is provided) have been advanced for enabling a skilled locksmith to remove key-receivable plug assemblies from the barrels of locks and switch locks once the locks and switch locks have been removed from their installation sites; however, these proposals, too, have tended to be characterized by drawbacks. Often, such proposals require the provision of a lock disassembly environment wherein a host of specially configured tools are readily at hand, such as is found in the shop of a locksmith. Some of the proposals call for the very precise drilling of one or more holes through sidewall portions of the barrel of a lock or switch lock to directly access components of the plug-retaining mechanism so that one or more components can be moved in ways that will defeat the operation of the plug-retaining mechanism and will thereby permit the plug assembly to be removed from its barrel.

Many of these "other proposals" are difficult if not impossible to implement on-site and without removing the entire lock or switch lock assembly from its installed position. Often, the environment of an installation does not afford needed room to adequately access external surfaces of the installed lock or key lock. Furthermore, proposals that involve drilling or the performing other operations on an installed lock or switch lock may be inappropriate for use at the site of an installed lock or switch lock inasmuch as they unacceptably risk damage to property and/or injury to personnel.

Thus, a need remains in on-site environments where locks and switch locks are installed for methods and means that can be utilized to safely, easily and nondestructively permit the removal, servicing and/or replacement of plug-type operator assemblies 1) without disturbing in any way the existing installation of the barrels of the locks and switch locks, 2) without requiring access to any parts of the locks and switch locks other than the front-most portions thereof that normally are accessible, 3) without causing the degree of security that is provided by the installed locks and switch locks to be diminished (once they have been reassembled), and 4) without doing anything that risks damage to the locks and switch locks, to the surrounding environment, or to personnel.

Still another need that is not addressed satisfactorily by prior proposals is encountered when equipment such as mainframe computer components are to be installed through the cooperative efforts of persons possessing a variety of needed skills, few if any of whom ought to be granted access to the key or keys that ultimately will be used to prevent unauthorized persons from accessing and operating the equipment. During installation (and also at other times during the service life of the equipment such as when the equipment is being moved to a new site), personnel who eventually should be excluded from being able to access the equipment need to be able to open normally lockable cabinets and to operate normally lock-controlled switches—whereby, there is a need for a simple method and means that permits the equipment's relatively high security plug assemblies to be removed (under controlled conditions) from the installed barrels of locks and switch locks, and to substitute relatively low security plug assemblies and/ or manually operable plug assemblies in place of selected ones of the high security key-operated plug assemblies. By such an arrangement, undesired access to equipment-operating keys can be denied to those who should not have such access while, at the same time, permitting such activities as installation, servicing and moving of the equipment to proceed unhindered by the absence of normally required equipment-operating keys.

The extent to which a particular lock or switch lock is deemed to be "secure" depends to a significant degree on the character of the locking mechanism and its key, and on how the locking mechanism functions. Locks and switch locks are known that offer relatively high security by using complexly configured, precision formed keys to operate relatively large numbers of plug-carried tumblers that must be correctly positioned simultaneously in order to permit plug-type operator assemblies to be rotated relative to surrounding barrels between pairs of angularly spaced positions. Locks and switch locks of this type are exemplified by those that are sold by The Illinois Lock Company division of The Eastern Company and that have keys that bear the registered trademark DUO.

Double-bitted key-operated locks such as DUO locks have been commercially available for many years. However, because the best mode known to the inventors for carrying out the preferred practice of the present invention involves utilizing of selected features of DUO locks to enhance the security of the resulting lock and switch lock products, a brief overview of relevant features of typical DUO lock components is included here.

One feature of a DUO key is that it actually has three "cuts" or "serratures," namely two "primary" serratures and a "secondary" serrature. The primary serratures give the key its "double bitted" character in that the primary serratures are defined by opposed wavy outer edge formations that are cut into opposed edge portions of a pair of flanges that extend in opposite directions from a relatively thicker, grooved, elongate central region of the body of the key. The primary serratures are among the most notable features of the body of a DUO key (i.e., the primary serratures define the width of the body along the majority of the length of the body, and therefore constitute prominent elements of the appearance of a DUO brand key). In contradistinction, the secondary serrature is a "single bitted" cut that extends relatively inconspicuously along one surface of the relatively thick central region.

While the secondary serrature is independently configured (i.e., its configuration is not dictated by the configuration of either of the primary serratures), the configurations of the primary serratures are interdependent in the sense that they are "oppositely coordinated." As one edge of the body portion of a DUO key curves away from the central region (due to the shape of one of the primary serratures), the corresponding opposite edge of the body portion curves inwardly toward the central region (due to the "oppositely coordinated" shape of the other of the primary serratures). One effect that results from the way in which the configurations of the primary serratures are "oppositely coordinated" is that the width of the body (i.e., the distance between the opposed primary serratures as measured transversely relative to the grooved central region of the body of the key) is maintained relatively constant along a majority of its length.

The key is insertable along a keyway that opens through the front end of a plug assembly and parallels a central axis that extends through the plug-receiving chamber of the barrel. A tumbler positioning compartment having opposed side walls that extend along on opposite sides of the keyway is formed in the body of the plug. A front end wall of the tumbler compartment is located just behind the enlarged diameter head formation that is defined by the front end region of the body of the plug. A rear end wall of the tumbler compartment typically is spaced along the central axis half an inch or more rearwardly from the front end wall, whereby space is provided within the tumbler compartment to hold a substantial number of wafer-like members that are arranged side-by-side so as to extend in parallel planes that are transverse relative to the keyway and relative to the central axis. The opposed side walls that extend forwardly and rearwardly between the front and rear end walls carry a series of shallow groove formations or splines that help to guide and position the wafer-like contents of the tumbler compartment.

Beginning at the front end wall of the tumbler compartment and extending rearwardly, the contents of the tumbler compartment typically comprise a number of wafer-like components including what can be through of as "sets" of wafer tumblers that are separated by wafer-like key guides. When a double-bitted key is inserted along the keyway, the oppositely coordinated primary serratures of the key pass through precisely configured holes (i.e., "piercings") that are formed through the tumblers and through the key guides; and, at the same time, the secondary serrature also moves through these same piercings. Because a close "working clearance" is provided between the opposed primary serratures and opposed ends of the tumbler piercings, movement of the key along the keyway will cause the tumblers to be moved transversely relative to the keyway in a positive fashion that does not rely on any external force (e.g., gravity, spring biasing force, etc.) to assure that the tumblers are moved to positions that correspond to the configurations of the key serratures.

The key guides emulate the cross-section of portions of an appropriately configured key so as to guide the key for smooth movement along the keyway and through the piercings of the tumblers. The key guides do not move transversely relative to the keyway; rather, they remain stationary once inserted into a splined central section of the body. The key guides cooperate with a machined opening that is formed in the enlarged diameter head of the body of the plug to assist in guiding a properly configured key into and out of an unlocking position. When a properly configured key is fully inserted into a plug assembly to its "unlocking" position, the engagements made by end regions of the tumbler piercings with the serratures of the key cause the tumblers to align with peripheral portions of the generally cylindrical body of the plug to permit the plug to rotate about the central axis relative to the surrounding barrel.

So that end portions of the tumblers of a DUO lock will tend to project radially outwardly with respect to the generally cylindrical plug body when no *correctly* configured key is inserted into the keyway, compression coil springs are provided, with each tumbler being biased radially outwardly with respect to the plug body by virtue of its being engaged by a separate spring end region. Some pairs of adjacent tumblers of a DUO lock typically are biased in opposite directions by compression coil springs that are interposed between the adjacent tumblers. Others of the tumblers (typically some that reside adjacent the key guides) are biased outwardly by springs that engage the key guides.

DUO locks typically utilize 1) opposed pairs of "primary" tumblers that are positioned by the "oppositely coordinated" key serratures that are referred to by the term "primary," and 2) an interspersed array of "secondary" tumblers that are positioned by the independently configured key serrature that is referred to by the term "secondary." In a DUO lock, typically about every third tumbler that is positioned along the keyway is a secondary tumbler. The most common arrangement of wafer-like components in the tumbler compartment of a DUO plug body includes four components, namely three tumblers and one key guide. Typically, such four-component sets include a pair of adjacent, opposed primary tumblers (i.e., they project from opposed sides of the generally cylindrical body of the plug into opposed spline formations that are defined within the interior of the surrounding barrel), a secondary tumbler (since it rides on a single bitted serrature, all of the secondary tumblers tend to project from the body of the plug into a single one of the opposed spline formations of the barrel), and a key guide. Usually, the secondary tumbler is sandwiched between the key guide and one of the primary tumblers. Four-component sets of this nature are arranged one after another extending from the front end wall of the tumbler compartment toward the rear end wall. A typical DUO lock has four such sets followed by "added" wafer-like components that typically include at least a pair of "added" opposed primary tumblers, perhaps an "added" secondary tumbler and an "added" key guide, with empty positions typically being filled by "dummy" tumblers that serve principally to assist in maintaining the "added" components in proper locations within the tumbler compartment.

In operation, when no properly configured key is in an operating position along the keyway of a DUO lock, end regions of the tumblers project from opposite sides of the body of the plug for extension into splined recesses that are defined by the interior configuration of the barrel that surrounds and protectively enshrouds all but a forward end portion of the plug through which the keyway opens. However, insertion of a properly configured key along the keyway to its unlocking position causes the tumbler ends to align with peripheral portions of the body of the plug, whereby the plug is permitted to rotate between at least a pair of angularly spaced positions.

SUMMARY OF THE INVENTION

The present invention addresses the need for providing a relatively high security lock with a plug assembly that is releasably retained within a surrounding barrel, and that can, under controlled circumstances, be easily removed from the barrel for service and/or for replacement by an alternate plug assembly.

A feature of a lock or switch lock that embodies the preferred practice of the present invention resides in the capability that is provided to remove, service and/or replace the plug assembly without a need for a plethora of special tools, without a need for a specially configured "control" key, and without requiring access to portions of the lock or switch lock beyond such portions as normally remain exposed after the lock or switch lock has been duly installed on a closure or instrument panel or the like.

Another feature of a lock or switch lock that embodies the preferred practice of the present invention is the versatility that results through providing a barrel that has an interior that is configured to cooperatively interact with a wide variety of types of substitutable plug-type operator assemblies. One such plug assembly provides a relatively high security lock or switch lock, while another provides a manually operated plug assembly that requires no key at all to operate the lock or switch lock—features of both of which now will be summarized.

A relatively high security lock or switch lock is provided by installing a double-bitted key-operated multi-tumbler plug assembly (e.g., such plug assemblies as are sold by the aforementioned Illinois Lock Company having double-bitted, triple-serratured keys that bear the registered trademark DUO) that includes both "locking" and "retaining" sets of opposed tumblers. In the most preferred practice of the present invention, a relatively high security plug assembly includes 1) a substantial number of "locking" tumblers that simultaneously engage a pair of opposed, barrel-carried spline formations (i.e., spline formations that are defined in opposite sides of the interior of the barrel) to prevent unauthorized rotation of the plug assembly within the barrel, and 2) a number of opposed "retaining" tumblers that extend into a special retaining groove that is defined by the interior configuration of the barrel so that the "retaining" tumblers that engage the retaining groove provide a "secondary" plug-retaining function that is executed entirely independently from a "primary" plug-retaining function that is implemented by a separate spring-biased plug retaining mechanism that also is interposed between the plug assembly and the barrel to prevent plug assembly removal except when a set of controlled conditions are fully satisfied.

By substituting for the above-described relatively high security key-operated plug assembly a much simpler manually operated plug assembly that is held in place by the same type of spring-biased plug retaining mechanism that is utilized with the key-operated plug assembly, installed locks and switch locks can be temporarily converted to permit their being operated by persons who do not ordinarily have access to keys that operate the locks and switch locks. This feature permits normally unauthorized personnel to attend to needed work without concerns arising due to high security keys being made accessible to persons who eventually ought not be permitted to operate the locks and switch locks.

Moreover, in installations where, during moving of equipment and the like, locks and switch locks ought to remain under key control but ought to do so without causing high security keys to be made accessible to unauthorized persons, the above-described relatively high security key-operated plug assembly can be replaced with a much less complex, less expensive, relatively low security key-operated plug assembly that employs relatively few tumblers, that can be single-bitted or double-bitted in character, and that is held in place by the same type of spring-biased plug retaining mechanism that is utilized with the key-operated plug assembly. Thus, "temporary" keys can be provided that will function quite nicely to temporarily operate locks and switch locks for a requisite interval of time, but which will cease to operate the locks and switch locks once the relatively high security plug assemblies have been reinstalled in the barrels of the locks and switch locks.

Other features that are embodied in the preferred practice of the present invention have to do with the structural arrangement of components of a key-operated plug assembly that interact with interior formations of an enshrouding barrel to prevent removal of the plug assembly from the barrel except under controlled conditions. Such conditions preferably require that a properly configured key to be engaged with the plug assembly to effect "unlocking" of the plug assembly for rotation relative to the barrel. Further, such conditions preferably require that the barrel to be rotated to a predetermined angular position to align portions of a retaining member with a tool-receiving hole so that the tip of an elongate tool can be inserted through the tool-receiving hole to move the retaining member in opposition to spring biasing action to a plug releasing position that permits the plug assembly to be withdrawn from the barrel. In the absence of such conditions being fully met, locks and switch locks that embody the preferred practice of the present invention include complementary grooves that are defined within the barrel and the plug assembly for receiving portions of at least one retaining member that bridges the complementary grooves to assume a retaining position where it is held under the action of spring bias, with the plug assembly being prevented from being removed from the barrel when the retaining member is in its retaining position.

In preferred practice, features of the present invention are incorporated in a switch lock of the general type that has the housing of an electrical switch assembly rigidly connected to the barrel of a key-operable lock, with the switch being operated by rotatably positioning a switch operator formation that is drivingly engaged by a key-receivable plug assembly of the lock. While a number of features of the present invention can be utilized outside the environment of a switch lock, maximum usage of the features of the invention is believed to be achieved by utilizing features of the invention in the environment of a switch lock that includes a rotary switch assembly that is selected to be of a type that has discrete operating positions, and that has a spring detenting mechanism for urging the rotary operator of the switch toward and maintaining the rotary operator in discrete operating positions as rotation of the switch operator nears each such position. By utilizing a detented rotary electrical switch with the aforedescribed removable/substitutable plug assemblies, the detent action of the switch serves to maintain desired positioning of the rotary operator of the switch during substitution of plug assemblies—whereby the need to orient a replacement plug assembly with the rotary operator of the switch so that a driving connection can be formed therebetween is simplified. Furthermore, the detenting action of the switch aids in detenting an installed plug assembly toward appropriate angularly spaced switch-operating positions.

In view of the foregoing discussion, it will be understood that a lock or switch lock that incorporates features of the present invention typically has a generally cylindrical barrel that defines a centrally extending, forwardly opening chamber for selectively receiving and positioning either of a pair of substitutable plug-type operator assemblies at an operating position. A selected one of the plug assemblies is inserted into the chamber by moving the selected plug assembly rearwardly through the front opening and along an imaginary axis that extends centrally through the chamber. A plug assembly that has been inserted to the operating position is releasably retained within the enshrouding barrel by a retention mechanism that includes a retainer that is moved by spring bias to a plug-retaining position wherein the retainer bridges complementary formations that are defined by the barrel and by the inserted plug assembly. A retained plug assembly that has been inserted to the operating position can be rotated about the central axis relative to the barrel between at least a pair of angularly spaced positions. One of the plug assemblies preferably is key-operated and has tumblers that are engageable with interior portions of the barrel for locking the one plug assembly in at least one of the angularly spaced positions unless the one plug assembly is unlocked by a suitably configured key. The other of the substitutable plug assemblies preferably is manually operated and has an manually engageable operating formation such as a knob. When substituted for the key-operated plug assembly, the manually-operated plug assembly permits the lock or switch lock to be operated without the need for a key.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
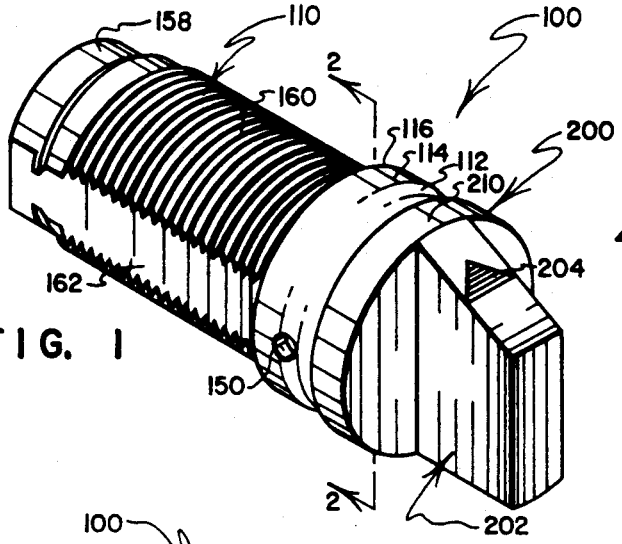
FIG. 1 is a perspective view of a lock that embodies features of the present invention, with the lock having a generally tubular barrel for receiving, enshrouding and rotatably mounting unseen portions of a plug-type operator assembly, with the view showing front portions of a manually-operable plug-type operator assembly having a knob that is rotatable relative to the barrel between at least two angularly spaced positions that are referred to by the terms "nine o'clock" and "twelve o'clock," with the knob carrying an arrow-type indicator pointing upwardly to indicate that the plug assembly has been rotated to its twelve o'clock position, and with a front rim of the barrel having a tool receiving opening that is located at the nine o'clock position.
Figure 7:
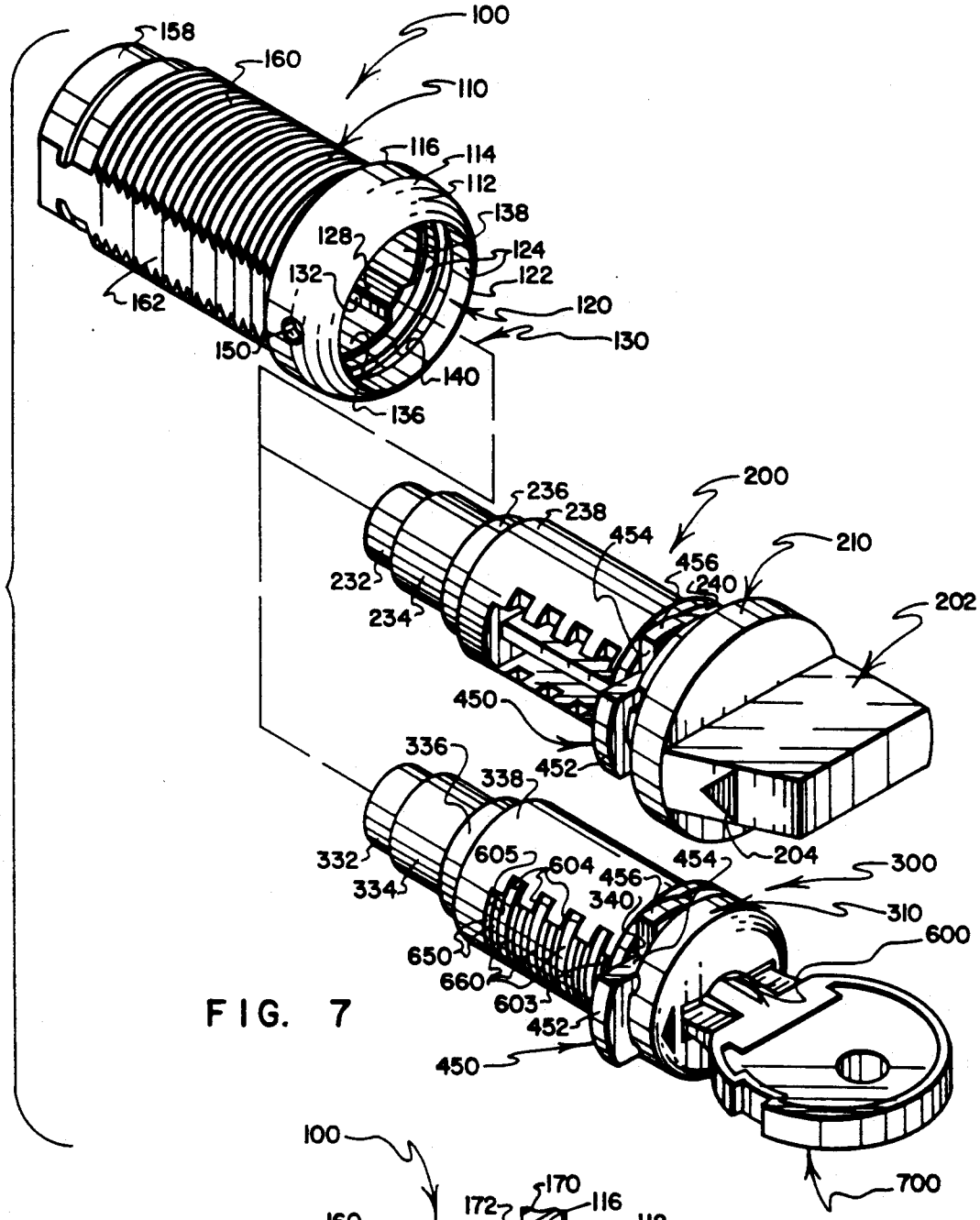
FIG. 7 is an exploded perspective view showing the manually-operable plug assembly removed from the barrel, and showing a relatively high security key-operated plug assembly that is substitutable into the barrel in place of the manually-operable plug assembly, with a suitably configured key shown inserted into the key-operated plug assembly so as to retract its plurality of tumblers to an "unlocked" position that permits the key-operated plug assembly to be rotated within the barrel between at least the nine and twelve o'clock positions once the key-operated plug assembly has been inserted into the barrel to an operating position.
Figure 11:
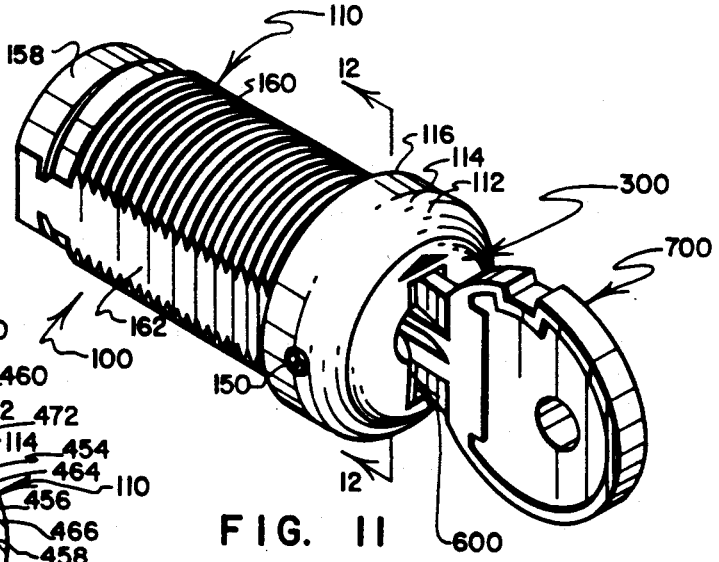
FIG. 11 is a perspective view similar to FIG. 10 but with no portions of the barrel being broken away, and with the key-operated plug assembly being rotated to the twelve o'clock position.

Referring to FIGS. 1, 7 and 11, a lock assembly that embodies features of the preferred practice of the present invention is indicated generally by the numeral 100. As is best seen in FIG. 7, the lock 100 includes a tubular, barrel-like housing 110 that defines a forwardly opening chamber 120 into which either of a pair of substitutable plug-type operator assemblies 200, 300 may be installed. For the sake of simplicity, the terms "barrel" and "plug assembly" are used herein to refer to the housing 110 and to the assemblies 200, 300, respectively.

Figure 3:
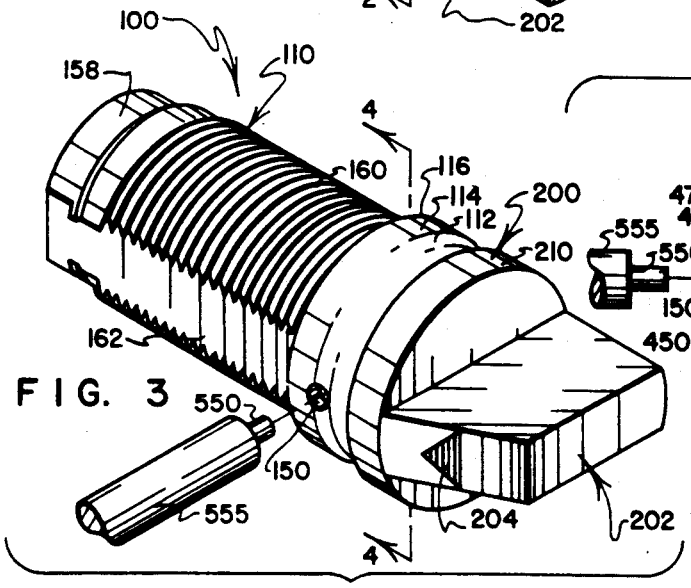
FIG. 3 is a perspective view similar to FIG. 1 but showing the manually-operable plug assembly rotated relative to the enshrouding barrel to a nine o'clock position, and showing portions of an elongate tool having a reduced diameter tip that is insertable into the tool receiving opening.
Figure 10:
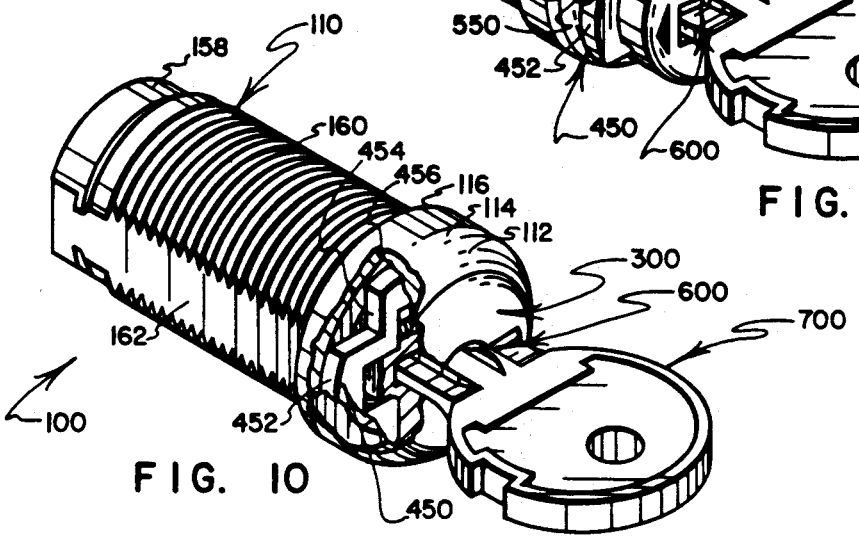
FIG. 10 is a perspective view similar to FIG. 9 but showing the key-operated plug assembly duly installed within the barrel, with portions of the barrel being broken away to permit portions of the retaining member to be viewed bridging complementary groove formations that are provided by the barrel and the plug assembly for enabling the retainer member to releasably retain the key-operated plug assembly within the barrel.

In FIG. 1 the plug assembly 200 is shown duly installed in the barrel 110 at its "operating position" wherein it can be rotated between angularly spaced positions such as the twelve o'clock position that is depicted in FIG. 1 and the nine o'clock position that is depicted in FIG. 3. In FIG. 11, the plug assembly 300 is shown duly installed in the barrel 110 at its "operating position" wherein it, likewise, can be rotated between angularly spaced positions such as the twelve o'clock position that is depicted in FIG. 11 and the nine o'clock position that is depicted in FIG. 10.

The plug assembly 200 is "manually-operable" in that it is provided with a knob 202 and can be manually operated to rotate the plug assembly 200 relative to the barrel 110 between angularly spaced positions without need of a key. The knob 202 carries an arrow-like pointer 204 to indicate the angular position of the plug assembly 200. The plug assembly 300 is "key-operated" in that it must be "unlocked" by a suitably configured key 700 (best seen in FIG. 19) before it can be rotated relative to the barrel 110 between angularly spaced positions.

Figure 16:
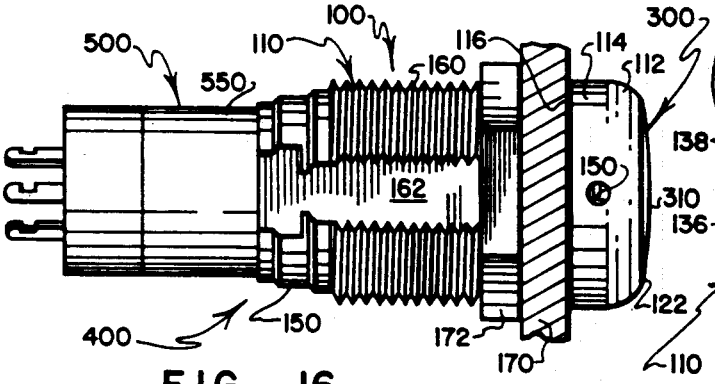
FIG. 16 is a left side elevational view of a switch lock that embodies features of the present invention, with the barrel of the switch lock shown extending through portions of a mounting plate, and with the mounting plate portions being clamped between 1) a nut that is threaded onto outer surface portions of the barrel, and 2) a mounting shoulder that is provided adjacent the front rim of the barrel.
Figure 18:
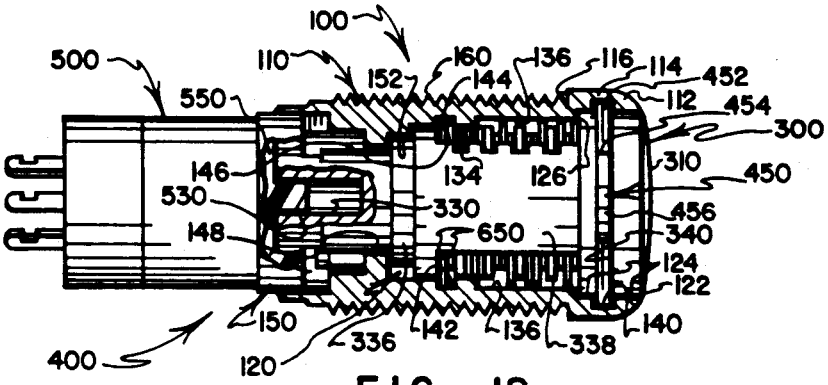
FIG. 18 is a left side elevational view of the switch lock of FIG. 16, but shown with all portions of the mounting plate removed, with portions of the barrel being broken away to permit left side portions of an installed key-operated plug assembly to be viewed, with rear body portions of the plug assembly and portions of the electrical switch assembly being broken away to enable components that establish a driving connection to be viewed, with the plug assembly being oriented in its twelve o'clock position, and with the view showing the "locked" positions that are assumed by the plug-carried tumblers when the key is removed from the plug assembly thereby freeing the tumblers to move under the influence of spring bias so as to cause end regions of a number of the tumblers to project from the body of the plug and into one or the other of a pair of opposed spline formations that are defined within bottom and top interior portions of the barrel; and, FIG. 19 is an exploded perspective view of the switch lock of FIG. 18 with portions of its barrel being broken away to permit the interior features of the barrel to be viewed, with the view including components and selected portions of both a key-operated plug assembly and a manually-operable plug assembly that can be substitutably installed in the barrel for rotating a rotatable operator of the electrical switch assembly that forms a part of the switch lock, and with all of the illustrated components being oriented a quarter turn clockwise in comparison with the positions in which many of the same components are depicted in the exploded view of FIG. 7.
Figure 19:
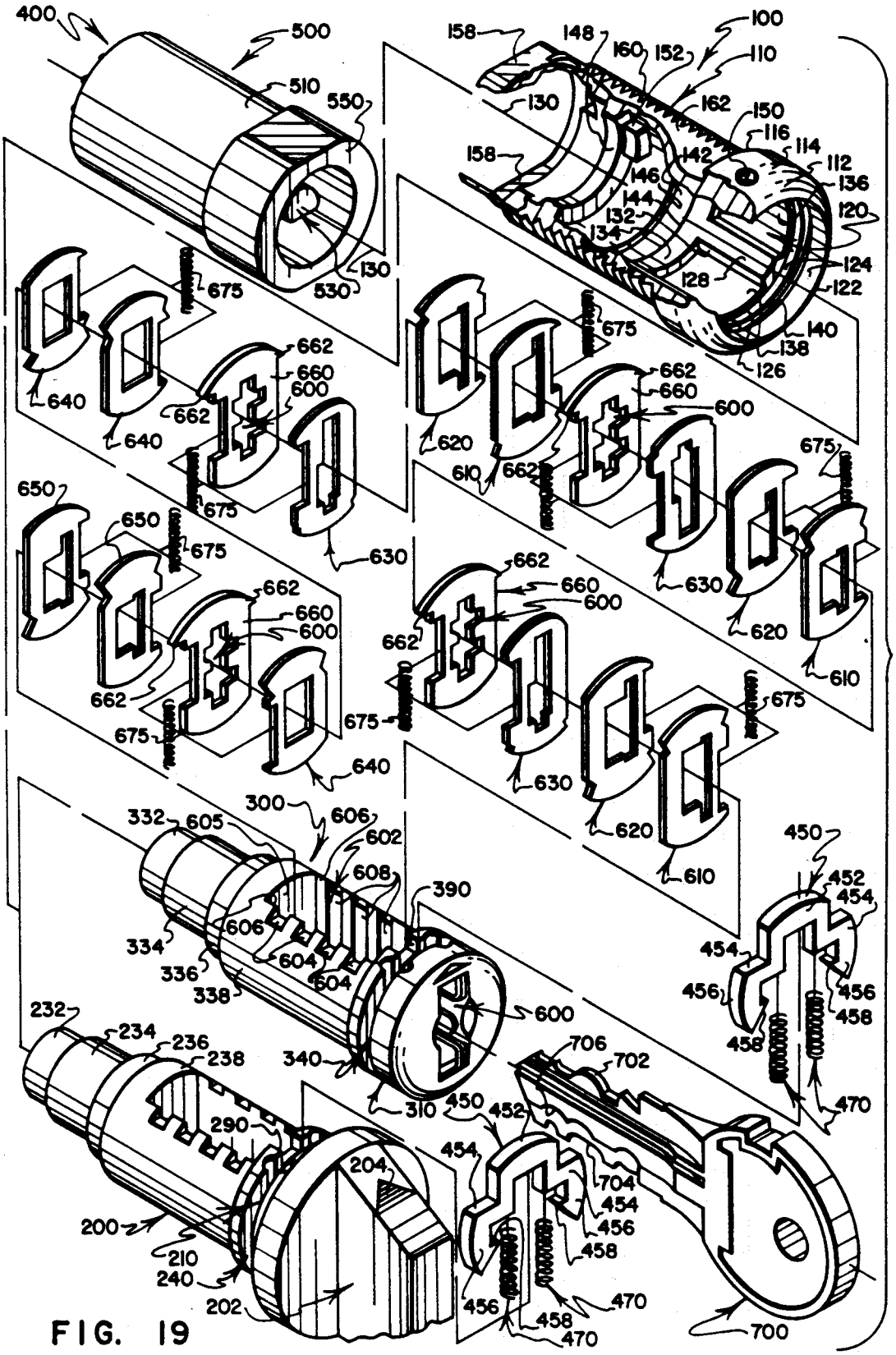

Referring to FIGS. 16, 18 and 19, in the preferred practice of the present invention, the lock assembly 100 forms a component of a switch lock assembly 400. The switch lock 400 can employ a wide variety of types of commercially available rotary electrical switches such as the switch assembly that is indicated generally by the numeral 500. The switch assembly 500 has a generally tubular housing 510 with a forwardly extending ring-like portion 550 of generally tubular configuration that is matingly received by and rigidly connected to a thin, tubular, rearwardly extending portion 158 of the barrel 110. In preferred practice, the manner in which this connection is formed corresponds with the disclosures of at least two of the referenced Switch Lock Patents, namely U.S. Pat. Nos. 4,566,167 and 4,427,852, the disclosures of which are incorporated herein by reference. Likewise, in preferred practice, the rotary electrical switch 500 corresponds with the general type of switch that is disclosed in these or others of the referenced Switch Lock Patents.

Figure 13:
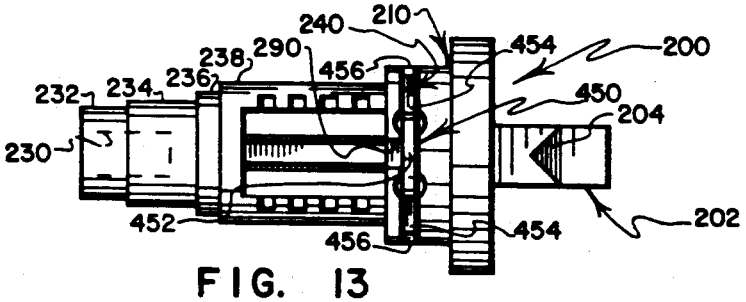
FIG. 13 is a top plan view of the manually operable plug assembly that is depicted in FIGS. 1-7, with the plug assembly in its twelve o'clock position.
Figure 14:
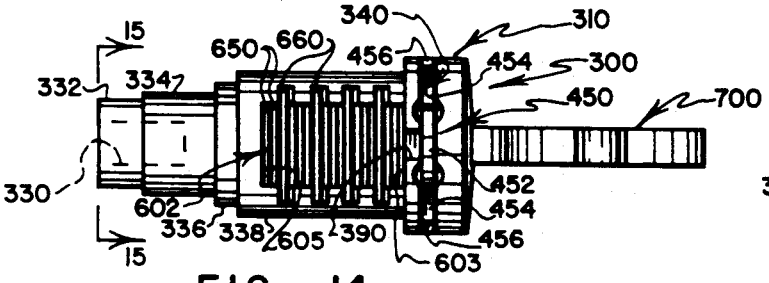
FIG. 14 is a top plan view of the key-operated plug assembly that is depicted in FIGS. 8-12, with the plug assembly in its twelve o'clock position.
Figure 15:
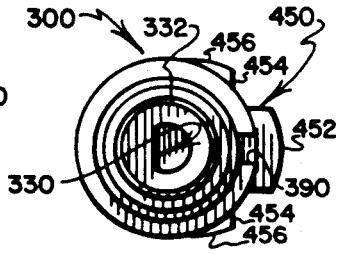
FIG. 15 is a rear end elevational view of the key-operated plug assembly as seen from a plane indicated by a line 15—15 in FIG. 14.
Figure 17:
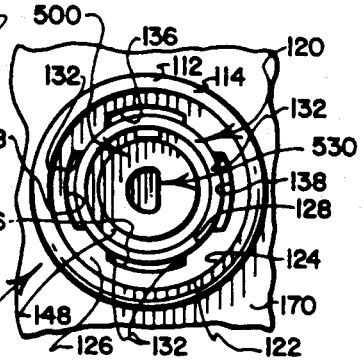
FIG. 17 is a front elevational view showing portions of the plate-mounted barrel and switch assembly that is used in the switch lock of FIG. 16, with the plug assembly removed from the barrel to permit forwardly-facing portions of the switch assembly that are located within the barrel to be viewed.

Referring to FIGS. 17 and 19, the switch assembly 500 has a rotatable shaft 530 that extends forwardly into the rear end region of the barrel chamber 120 along an imaginary central axis that is indicated by the numeral 130 in the exploded views of FIGS. 7 and 19. The rotatable shaft 530 is a rotary operator that, when rotated about the central axis 130 between at least a pair of predetermined angularly spaced positions, serves to effect operation of the switch 500. The shaft 530 has a D-shaped cross-section that is engaged by one of a pair of correspondingly configured D-shaped openings 230, 330 (indicated by hidden lines in FIGS. 13 and 14) that are defined by rear end regions 232, 332 of the plug assemblies 200, 300. The D-shaped opening 330 is shown most clearly in FIG. 15. Thus, by virtue of the provision of the D-shaped openings 230, 330, the shaft 530 is caused to be drivingly engaged by rear end portions 232, 332 of whichever one of the plug assemblies 200, 300 that may have been duly installed in the barrel 110 at what is referred to herein as an "operating position."

Referring to FIGS. 7 and 19, the barrel 110 has an enlarged rim formation 112 that provides a smoothly configured outer surface 114 that extends forwardly from a rearwardly-facing mounting shoulder 116. As the surface 114 extends forwardly, it eventually curves inwardly to a position where a front opening 122 of the chamber 120 is defined. The opening 122 is circular and is concentric about the imaginary central axis 130. The opening 122 is defined at the juncture of the outer surface 114 with a generally cylindrical inner surface 124 that extends from the opening 122 rearwardly, concentrically along the central axis 130. Thus, the inner surface 124 defines a front end region of the chamber 120 at a location that is surrounded by the rim formation 112.

At a location a short distance inside the front opening 122, a ring-like groove 140 opens through the inner surface 124. The groove 140 faces radially inwardly toward the axis 130 at a location that is surrounded by the rim 112. A tool receiving hole 150 is formed through the rim 112 and opens into the groove 140 at what will be referred to as a nine o'clock position.

Figure 8:
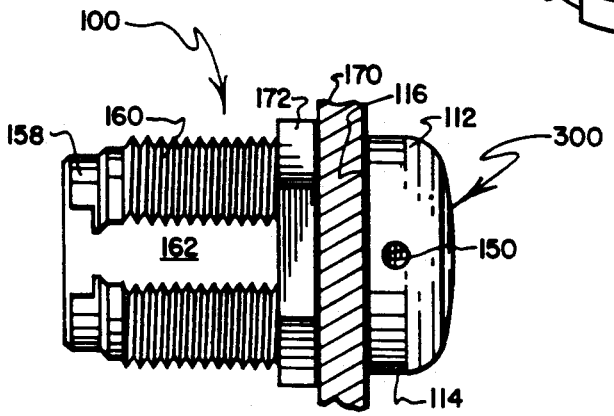
FIG. 8 is a side elevational view of the lock of FIG. 1 with the key-operated plug assembly shown in FIG. 7 substituted for the manually-operable plug assembly, with the barrel of the lock extending through portions of a mounting plate, and with mounting plate portions clamped between 1) a nut that is threaded onto outer surface portions of the barrel, and 2) a mounting shoulder that is provided adjacent the front rim of the barrel.

The barrel 110 has a threaded, generally cylindrical outer surface 160 that is located between the mounting shoulder 116 and the rearwardly extending barrel portion 158. At least one flat surface 162 is provided on at least one of the sides of the barrel 110 to interrupt the threads 160 and to assist in properly orienting the barrel 110 for mounting. In a typical installation, the barrel 110 is inserted through a mounting opening (not shown) that is formed through a mounting plate, for example the mounting plate 170 that is depicted in FIGS. 8, 16 and 17. In preferred practice, a threaded fastener such as the nut 172 that is shown in FIGS. 8 and 16 is provided for threading onto the threaded outer surface 160 of the barrel 110 for enabling opposite sides of the plate 170 to be engaged and clamped between the mounting shoulder 116 and the nut 172. Typically, the mounting plate 170 may comprise portions of an instrument panel, a cabinet structure, a closure or the like that has been selected as a mounting place for the barrel 110.

Referring to FIGS. 17–19, the interior of the barrel 110 includes a number of inwardly extending formations. A radially inwardly extending shoulder 126 is provided at the rear of the relatively large diameter inner surface 124. As is best seen in FIGS. 17 and 19, the shoulder 126 extends radially inwardly to join with segments of a cylindrical inner surface 128 that are defined by an angularly spaced array of four axially extending rib-like formations 132. The inner surface segments 128 comprise arcuate segments of a common cylindrical surface that has a diameter that is less than the diameter of the inner surface 124, and that extends coaxially with respect to the central axis 130.

Rear end regions of the rib-like formations 132 join with a ring-like formation 134 that extends in an uninterrupted band about the interior of the barrel 110. The inner surface of the ring 134 is a continuation of the cylindrical inner surface 128, portions of which are defined by the rib-like formations 132.

With continued reference to FIGS. 17 and 19, it will be seen that, defined between adjacent pairs of the four axially extending rib-like formations 132 are two opposed pairs of axially-extending spline-like recesses 136, 138. While only one of each of the recesses 136, 138 can be seen in FIG. 19, all four of the recesses 136, 138 can be seen in FIG. 17. The recesses 136 extend axially along top and bottom portions of the interior of the barrel 110 and are located at twelve and six o'clock positions. The recesses 138 extend axially along opposed side portions of the interior of the barrel 110 and are located at nine and three o'clock positions.

As will become apparent as the description continues, it is the function of the spline-like recesses 136, 138 to cooperate with plug-carried tumblers to lock an inserted plug assembly against rotation relative to the barrel 110. When end regions of the tumblers that are carried by the key-operated plug assembly 300 extend into either of the opposed sets of spline-like recesses 136, 138, the result is to lock the plug assembly 300 from being rotated relative to the barrel 110. The opposed recesses 136 receive end regions of locking tumblers that are carried by the key-operated plug assembly 300 1) when the plug assembly 300 is in either a twelve or a six o'clock position, and 2) when the key 700 has been withdrawn from the plug assembly 300 so as to permit the spring-projected locking tumblers to move under the influence of spring bias to their locked positions (as is depicted in FIG. 18). The opposed recesses 138 receive end regions of locking tumblers that are carried by the key-operated plug assembly 300 1) when the plug assembly 300 is in either a nine or a three o'clock position, and 2) when the key 700 has been withdrawn from the plug assembly 300 to permit locking movement of its locking tumblers.

Referring to FIGS. 18 and 19, a secondary retainer groove 142 opens into the chamber 120 of the barrel 110 at a location immediately to the rear of the ring-like formation 134. A radially extending shoulder 144 defines the forward side of the groove 142. A radially extending shoulder 146 defines the rearward side of the groove 144. When the key-operated plug assembly 300 is duly installed in the barrel 110 at its operating position so as to be rotatable relative to the barrel 110 between angularly spaced positions described previously, and when the key 700 is removed from the plug assembly 300, a pair of opposed retaining tumblers 650 that are carried by the plug assembly 300 extend into the secondary retaining groove 142. When the retaining tumblers 650 extend into the secondary retainer groove 142, the primary retaining action that is provided by a spring-biased primary retainer member 450 (which action is described in detail later herein) is augmented so as to enhance the mechanical means by which the key-operated plug assembly 300 is held securely within the barrel 110. Moreover, even if the key-operated plug assembly 300 is oriented in its nine o'clock position at the time when the key 700 is removed, unless the key 700 is reinserted, the plug assembly 300 cannot be removed from the barrel (i.e., even if the plug assembly 300 is oriented at its most vulnerable position, namely nine o'clock, in which position it is possible to cause the primary retaining device 450 to move out of retaining engagement with the primary retaining groove 140—which can be effected as is described later herein by using a tip of an elongate tool inserted through the tool receiving opening 150—the secondary retaining action that is provided by plug-carried retaining tumblers 650 extending into the groove 142 will serve to securely retain the plug assembly 300 in place in the barrel 110).

Referring to FIG. 19, an inwardly extending ring formation 148 is provided at a location that is spaced a short distance forwardly from the tubular rear end portion 158 of the barrel 110. The ring 148 protectively surrounds and assists in journaling for rotation rearward end portions 234, 334 of the plug assemblies 200, 300, respectively (see FIGS. 7 and 19).

Depicted in FIG. 19 at a location slightly forward from the ring 148 is a stop formation 152. As is best seen in FIG. 18, the stop formation 152 is configured to reside alongside an intermediate diameter portion 336 of the plug assembly 300 (or alongside a corresponding intermediate diameter portion 236 of the plug assembly 200 if the plug assembly 200 is installed in the barrel 110 in place of the plug assembly 300). If desired, one or more stop formations (not shown) optionally can be provided on the surfaces 236, 336 for engaging the stop formation 152 to selectively limit the ranges of angular movement that can be executed by the plug assemblies 200, 300 relative to the barrel 110. However, in the embodiment described here, it is not desired to limit the rotation of the plug assemblies 200, 300 within the barrel 110 except to provide the mentioned locking capability whereby, when the key 700 is removed with the plug assembly 300 installed in the barrel 110, the plug assembly 300 will be locked in a selected one of four positions (i.e., in a three, six, nine or twelve o'clock position).

Referring to FIGS. 7 and 19, the plug assemblies 200, 300 have enlarged head formations that are indicated generally by the numerals 210, 310. The head formations 210, 310 have outer diameters that permit at least portions thereof to be inserted into the forward end regions of the barrel chamber 120 (i.e., into the region of the chamber 120 that is bounded by the cylindrical surface 122). The head formations 210, 310 are located immediately forwardly with respect to generally cylindrical body portions 238, 338 of the plug assemblies 200, 300. The body portions 238, 338 have generally cylindrical outer diameters that permit them to be inserted into such portions of the barrel chamber 120 as are surrounded by the surface 128 and the ring 134 so that the body portions 238, 338 can extend in juxtaposed relationship with the spline-like recesses 136, 138 and into overlying relationship with the secondary retainer groove 142 (as is best seen in FIG. 18). The body portions 238, 338 extend between the head formations 210, 310 and the aforedescribed intermediate diameter body portions 236, 336 that may optionally carry one or more rotation limiting stop formations (not shown), as has been described.

Figure 4:
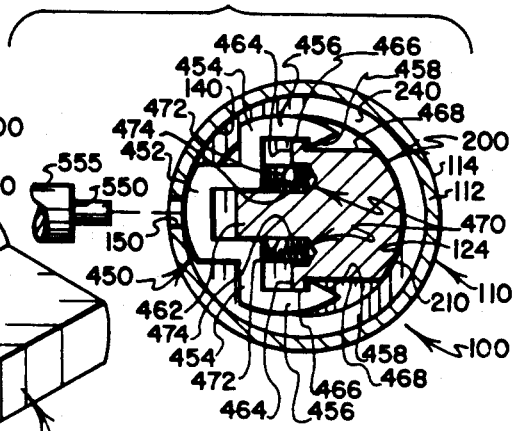
FIG. 4 is a sectional view, on a slightly enlarged scale, as seen from a plane indicated by a line 4—4 in FIG. 3, with this view showing the retainer member being aligned with the tool receiving opening so as to be operably accessed when the plug assembly is oriented as illustrated, namely in a nine o'clock position.
Figure 5:
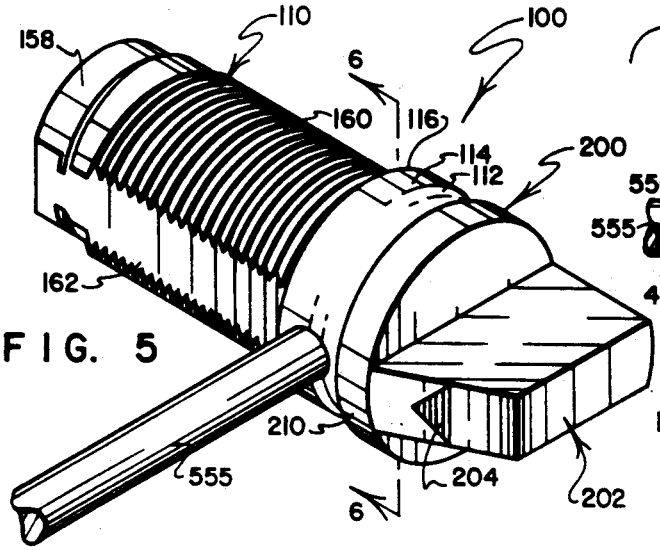
FIG. 5 is a perspective view similar to FIG. 3 but showing portions of the elongate tool positioned so that its reduced diameter tip extends into the tool receiving opening.
Figure 6:
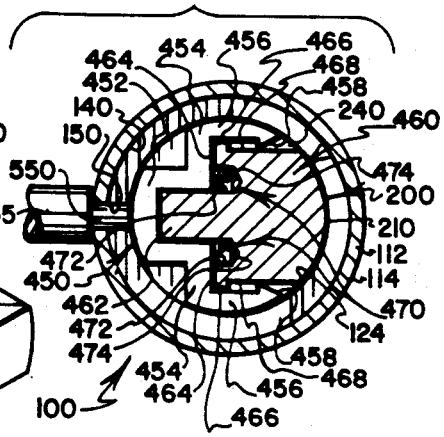
FIG. 6 is a sectional view, on a slightly enlarged scale, as seen from a plane indicated by a line 6—6 in FIG. 5, with the view showing the retainer member being operably accessed by the tip of the elongate tool so as to displace the retainer member into grooved body portions of the manually-operable plug assembly so that the plug assembly can be removed from the barrel.

Referring to FIGS. 7, 13, 14 and 19, features of a primary spring-biased plug retaining mechanism now will be described. In accordance with the preferred practice of the present invention, identical groove-like formations 240, 340 are provided within the head formations 210, 310; and, identical retainer clips 450 and compression coil springs 470 are carried by the grooves 240, 340. Features of the configuration of the groove-like formation 240 are illustrated in FIGS. 2, 4 and 6.

Figure 12:
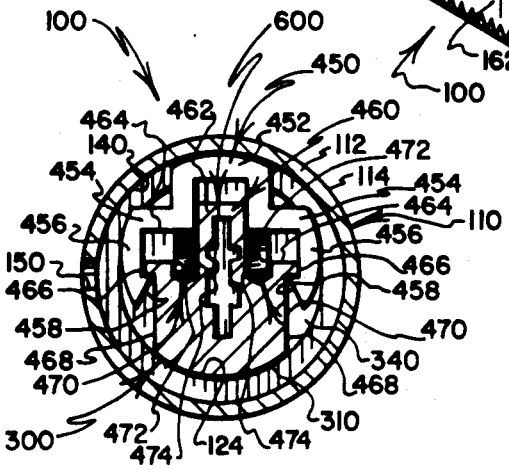
FIG. 12 is a sectional view on a slightly enlarged scale as seen from a plane indicated by a line 12—12 in FIG. 11.

Features of the configuration of the groove-like formation 340 are illustrated in FIG. 12. Features of the retainer clips 450 are depicted variously in FIGS. 2, 4, 6, 7, 12–14 and 19.

Figure 2:
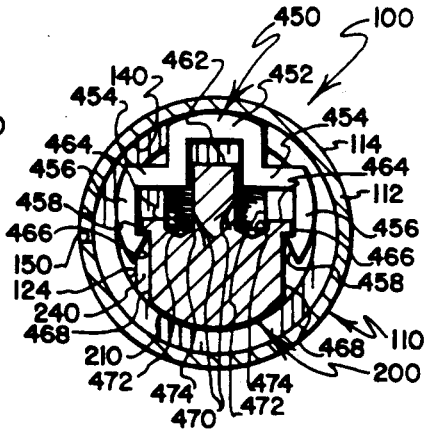
FIG. 2 is a sectional view, on a slightly enlarged scale, as seen from a plane indicated by a line 2—2 in FIG. 1, with this view showing a retainer member that forms a part of the manually-operable plug assembly and that can not be operably accessed through the tool receiving opening with the plug assembly oriented as illustrated, namely in a twelve o'clock position.

Referring to FIGS. 2, 12 and 19, each of the retainer clips 450 has a number of features that tend to be arranged substantially symmetrically about an imaginary center plane (not shown) that can be though of as dividing each retainer clip 450 into equal halves. Each retainer clip 450 has an outwardly convex central region 452 that is of generally inverted U-shape. Each has a pair of opposed arm portions 454 that connect with opposite sides of the U-shaped central region 452. Each has a pair of curved base portions 456 that connect at their upper ends with the arm portions 454, and that define inwardly extending barbs 458 at their lower ends.

Referring to FIGS. 2 and 12, each of the retainer clips 450 is installed in one of the grooves 240, 340 so as to wrap around a central core 460 of material that has a relatively narrow upstanding portion 462. The portion 462 projects upwardly into the U-shaped central region 452 of the associated retainer clip 450 to help guide inward and radial outward movements of the associated retainer clip 450. A pair of upwardly facing stop surfaces 464 are provided for engaging the arm portions 454 to limit the inward movement of the retainer clips 450. In FIG. 6, one of the retainer clips 450 is shown fully retracted into its associated groove formation 240, with the arm portions 454 of the clip 450 engaging one set of the stop surfaces 464.

A pair of opposed stop projections 466 are defined in part by the stop surfaces 464 and, in part by a pair of parallel side surfaces 468. The inwardly extending barbs 458 of each of the retainer claims 450 ride along the associated opposed side surfaces 468 as the clips 450 move inwardly and outwardly relative to the groove formations 240, 340. The outward limit of travel is reached when the barbs 458 engage the stop projections 466, as is depicted in FIGS. 2, 4 and 12.

The springs 470 reside in pairs of holes 472 that are drilled in each of the upwardly facing stop surfaces 464 at locations along opposite sides of the upper part 462 of the central core 462. The holes 472 have closed inner ends 474 that engage inner ends of the springs 470. Outer ends of the springs 470 engage the opposed arm portions 454 of the retainer clips 450.

As is seen in FIGS. 2, 4 and 12, the U-shaped central regions 452 of the retainer clips 450 project into the groove 140 of the barrel 110 when the groove-like formations 240, 340 align therewith—whereby the retainer clips 450 serve to bridge between the aligned, complementary grooves 140, 240 or 140, 340 to hold an inserted one of the plug assemblies 200, 300 in its operating position regardless of such relative rotation as may take place between the inserted plug assembly 200, 300 and the barrel 110.

Figure 9:
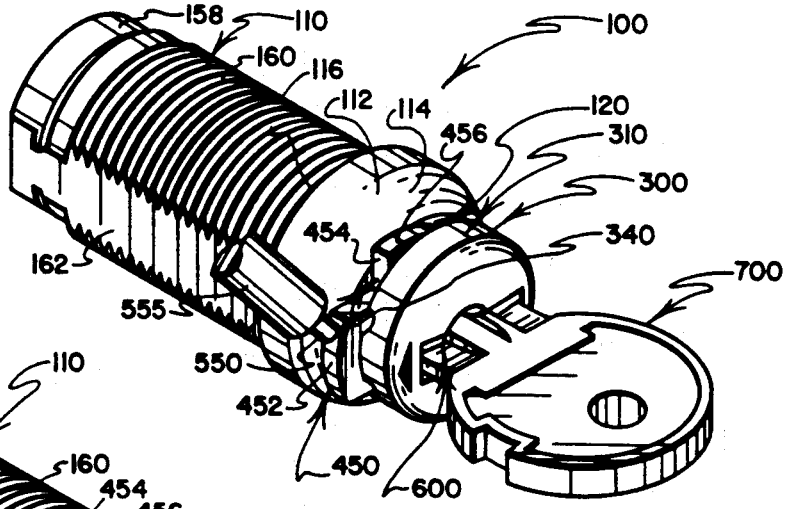
FIG. 9 is a perspective view showing the key-operated plug assembly at an intermediate stage during a process of inserting the key-operated plug assembly into the barrel, and showing tip portions of the elongate tool positioned to engage and depress the retaining member to permit the key-operated plug assembly to complete the process of being duly installed in the barrel.

Insertion of one of the plug assemblies 200, 300 into the barrel 110 can be effected quite easily by causing the associated retainer clip 450 to be retracted into its associated groove formation 240, 340 so that the clip-carrying groove formation 240, 340 can be inserted through the front opening 122 of the barrel 110. In FIG. 9, the positioning of a reduced diameter tip 550 of an elongate tool 555 is shown as indicating one means by which force in opposition to the action of the springs 470 can be applied to the associated retainer clip 450 to move the clip inwardly so that insertion of the plug assembly 300 to its operating position can be duly completed.

Once insertion has progressed to the point that the complementary grooves 140, 340 align, the biasing action of the springs 470 will move the clip 450 outwardly to extend portions of the clip 450 into the groove 140, thereby retaining the plug assembly 300 in its operating position (as is illustrated in FIG. 10).

Removal of the non-key-operated plug assembly 2100 from the barrel 110 is a simple process to carry out, and will be described in conjunction with reference to the various views that comprise FIGS. 1–6. Beginning with the plug assembly 200 rotated out of its nine o'clock position (e.g., with the plug assembly 200 being oriented in its twelve o'clock position, as is depicted in FIGS. 1 and 2), it will be observed that the central portion 452 of the retainer clip 450 is not so aligned with the tool receiving opening 150 that insertion of an elongate tool through the opening 150 will cause the retainer clip 450 to retract. Thus, the first step of the proper procedure for removing the plug assembly 200 from the barrel 110 is to rotate the plug assembly 200 to its nine o'clock position.

A second step is to insert the reduced diameter tip 550 of an elongate tool 555 into the tool receiving opening 150 (as is depicted in FIGS. 3–6) to push the retainer clip 450 into the groove 240 of the plug assembly 200 so that the plug assembly 200 can be withdrawn from the barrel 110. A third and final step is to effect the withdrawal of the plug assembly 200 as by moving it along the central axis 130 outwardly through the front opening 122. This three step procedure also is used as a part of a slightly more complex procedure that is needed to effect withdrawal of the key-operated plug assembly 300 from the barrel 110, as will be discussed shortly.

If an electrical switch 500 is coupled to the rear end of the barrel 110 as is shown in FIGS. 16–19, a feature of requiring that the plug assembly 200 or 300 be rotated to a nine o'clock position before it can be removed from the barrel 110 resides in the fact that this requirement causes the D-shaped shaft 530 of the electrical switch 500 being positioned in a detented position (and in an orientation that is definite and can be relied on when the time is at hand to replace a removed plug assembly). Because the mechanism of the switch 500 will retain the shaft 530 oriented in its nine o'clock position until a replacement plug assembly 200 or 300 is substituted, the substitution process proceeds smoothly if one will simply orient the replacement plug in a nine o'clock position during insertion—by which arrangement the D-shaped opening 230 or 330 that is defined on rear portions of the plug 200 or 300 will smoothly matingly receive the D-shaped shaft 530 during the installation of the replacement plug 200 or 300.

Removing the key-operated plug assembly 300 from the barrel 110 is initiated by first inserting a properly configured key 700 into the plug assembly 300 to withdraw all of the tumblers contained therein to their "unlocked" position, as is depicted in FIG. 7. Failure to take this required first step will leave a majority of the tumblers extending into locking engagement with one or the other of the opposed pair of spline-like recesses 136, 138 that are defined within the interior of the barrel 110, as is depicted in FIG. 18. Moreover, failure to take the required first step of inserting a properly configured key into the plug assembly 300 also will leave a pair of opposed tumblers 650 extending into the secondary retaining groove 142, as is depicted in FIG. 18.

However, once a properly configured key 700 is inserted into the plug assembly 300, the plug assembly 300 can be freely rotated to its nine o'clock position (i.e., such tumblers as were locked into engagement with opposed splines defined within the barrel 110 have been withdrawn to their unlocked positions in response to their being engaged by the key 700, whereby it is possible to rotate the plug assembly 300 relative to the barrel 110); and, the plug assembly 300 can be removed as by inserting the tool tip 550 into the tool receiving hole 150 as has been described in conjunction with FIGS. 1–6 (i.e., the tumblers 650 that were extending into engagement with the secondary retainer groove 142 have withdrawn to their unlocked positions by virtue of their engagement with the key 700, whereby the secondary retaining action of the secondary retaining tumblers has been released and withdrawal of the plug assembly 300 from the barrel 110 can proceed).

Referring to FIGS. 13–15 and 19, a feature of the preferred practice of the present invention resides in the provision of notches 290, 390 in the head formations 210, 310 of the plug assemblies 200, 300. The notches 290, 390 are centered behind the locations where central portions 452 of the retainer clips 450 project into the retaining groove 140 of the barrel 110, and represent a removal of a small amount of material that passes by the tool receiving opening 150 when the plug assemblies 200, 300 are being removed from the barrel 110. In essence, the material that has been removed to form the notches 290, 390 is material that could undesirably "catch" on the tip of a tool that is being used to depress an associated retainer clip 450 into an associated one of the grooves 240, 340; and, with such material removed, a plug assembly 200, 300 that is being withdrawn from the barrel 110 is assured of being able to pass smoothly by the tip of a tool that has been inserted through the tool receiving opening 150 to effect spring clip depression to permit withdrawal from the barrel 110 of a properly oriented plug assembly 200, 300.

Referring to FIGS. 2, 4 and 6 in comparison to FIG. 12, it will be seen that the core 238 of the plug assembly 200 has no keyway formed therein, whereas the core 338 of the plug assembly 300 has a keyway 600 extending therethrough. While both of the plug assemblies 200, 300 are depicted as having tumbler compartments at locations just behind their enlarged diameter heads formations 210, 310, no use is made of the tumbler compartment in the plug assembly 200. Indeed, in preferred practice, the tumbler compartment that is formed in the plug assembly 200 is not finish-machined to properly receive tumblers therein.

Referring to FIG. 19, the tumbler compartment 602 of the plug assembly 300 carries an array of opposed primary locking tumblers 610, 620, secondary locking tumblers 630, spacer-type dummy tumblers 640, opposed primary retainer tumblers 650, and key guides 660. The key guides 660 are formed from slightly thicker stock than are the tumblers 610, 620, 630, 640 and 650. The key guides 660 have centrally located piercings that carry the keyway formation 600 that is required by the key 700. Opposed arm projections 662 are formed on opposite sides of the upper end regions of the key guides 660. The arm projections 662 extend into a spaced array of recesses 604 that are provided along the top edges of the opposed side walls 606 of the tumbler compartment 602. The key guides also are slightly wider than the tumblers 610, 620, 630, 640, 650 and therefore are inserted into an array of spline-like grooves 608 hat are machined in the opposed side walls 660 of the tumbler compartment 602. By this arrangement, the key guides 660 not only are securely positioned at spaced intervals through the tumbler compartment 602 to assist the key 700 in moving along the keyway 600, but also serve to divide the tumbler compartment 602 into a plurality of separate regions that typically are sized to hold three of any of the tumblers 610, 620, 630, 640 and 650.

The arrangement of components in the tumbler compartment 602, beginning at the front end wall 603 thereof, typically calls for two oppositely primary tumblers 610, 620 to be provided with a spring 675 that biases the tumblers 610, 620 in opposite directions for locking engagement with one or the other of the opposed sets of barrel-carried splines 136, 138. Next is a secondary tumbler 630 followed by one of the key guides 660, with a spring 675 that biases the secondary tumbler 630 in the same direction that one of the primary tumblers 610, 620 is biased. This set of three tumblers 610, 620, 630 together with a key guide 660 and accompanying springs 675 is twice repeated, whereafter, instead of utilizing still another set of three "operating" tumblers (such as the tumblers 610, 620, 630), a set of three "dummy" tumblers 640 together with a key guide 660 and springs 675 are installed. Finally, a pair of retaining tumblers 650 accompanied by a spring 675 is installed at a location adjacent the rear end wall 605 of the tumbler compartment 602.

The utilization of the three dummy tumblers 640 and an accompanying key guide 660 assures that the tumbler compartment 602 is fully filled while, at the same time, assuring that no tumbler end regions will be caused to project beyond the periphery of the body 638 at a location where the body 638 passes through the inwardly extending ring formation 134 that is formed in the interior of the barrel 110. The positioning of two opposed retaining tumblers 650 adjacent the rear end wall 605 of the tumbler compartment 606 properly positions the retaining tumblers 650 for extension into the secondary retaining groove 142, as is illustrated in FIG. 18. Typically, the opposed retaining tumblers 650 take the form of an opposed set of the primary tumblers 610, 620 and, like the primary tumblers 610, 620, are operated by an opposed set of primary serratures formed on the key 700.

Referring still to FIG. 19, the key 700 preferably is of the type that is sold by the aforementioned Illinois Lock Company bearing the registered trademark DUO, namely a key 1) that provides opposed primary serratures 702, 704 that give the key a double-bitted character and that function to position both the primary tumblers 610, 620 and the retaining tumblers 650, and 2) that provides a single-bitted secondary serrature 706 that positions the secondary tumblers 630. As will be readily understood by those who are skilled in the art, the configuring of the serratures of the key 700 and the shaping of the piercings of the tumblers 610, 620, 630 and 650 varies from lock to lock as may be desired to assure that the holder of a key 700 of one configuration can not operate locks that are intended to be accessed only by keys of other configurations.

As will be apparent from the foregoing discussion taken in conjunction with the accompanying drawings and the claims that follow, the present invention provides a well designed system for providing locks, including even relatively high security locks, with substitutable plug-type operator assemblies that can include such plug assemblies as those that are manually operable without need of a key. Moreover, the system of the present invention permits plug assemblies to be easily substituted in installed locks without having to disturb the existing installations, without having to use a complex set of tools, and without requiring the use of specially configured "control" keys. Furthermore, features of the system of the present invention can be used to advantage in a variety of applications.

While FIGS. 8 and 16 depict the barrel 110 being mounted on a plate 170 with the tool receiving opening 150 being oriented in a nine o'clock position, and while the plug assemblies 200, 300 principally have been described herein as being rotatable relative to the barrel 110 between nine o'clock and twelve o'clock positions, those who are skilled in the art will understand that features of the present invention are not limited to any particular mounting of the barrel-like housing of a lock or switch lock, and that angular positions other than those named herein can be utilized without departing from the spirit and practice of the claimed invention.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A lock of the type comprising a plug having a transverse peripheral groove formed therein; a barrel having an outer surface with front portions thereof defining a ring-like rim that remains readily accessible when the barrel is installed on a suitably configured mount, a forwardly-facing opening that is surrounded by the rim, and an inner surface that extends rearwardly from the front opening to define a chamber within the barrel; with the chamber being configured to receive body portions of the plug and to position the plug at an operating position; with the plug being rotatable relative to the barrel between at least a pair of angularly spaced positions once the plug has been positioned at the operating position, with such rotation being about an imaginary central axis that extends forwardly through the center of the front opening and rearwardly through the chamber; a retaining member mounted in the transverse peripheral groove of the plug for projecting therefrom into a complementary groove that is formed in the inner surface at a location that is within close proximity to the rim; biasing means carried by the plug for biasing the retaining member outwardly with respect to the transverse peripheral groove such that portions of the retaining member are caused to extend into the complementary groove when the plug is received at the operating position within the barrel; a tool-receiving passage of relatively small cross section formed through the rim, with the passage 1) having an outer end that opens through the outer surface, 2) having an inner end that opens into the complementary groove, and 3) being oriented to permit insertion of a thin, elongated tool through the outer end and into engagement with the retaining member to move the retaining member in opposition to the biasing means to a plug-removal position wherein the retaining member is forced out of the complementary groove so that the plug can be removed from the barrel; a second groove defined by the inner surface at a location within the chamber that is spaced rearwardly from the location of the complementary groove; retention tumbler means carried by the plug for extending into the second groove to prevent removal of the plug from the barrel unless the plug is engaged by a suitably configured key that retracts the retention tumbler means from extending into the second groove, whereby the plug is locked against being removed from the barrel unless the plug is engaged by a suitably configured key; with the second groove extending within a plane that is transverse relative to the central axis, and with the second groove being configured to permit rotation of the plug relative to the barrel between said pair of angularly spaced positions while said retention tumbler means remains engaged with said second groove.

2. The lock of claim 1, wherein the plug has a generally cylindrical head of relatively large diameter in comparison with such portions of the plug as extend rearwardly from the head into the chamber, the transverse peripheral groove is formed in the outer diameter surface of the head, and a small notch is formed in the outer diameter surface to remove a narrow band of head material that otherwise would be provided by such portions of the generally cylindrical head as extend rearwardly from the location of the transverse peripheral groove, by which arrangement a narrow, axially extending band of head material is eliminated that otherwise might undesirably catch on tip portions of a narrow tool that is inserted through the passage to remove the retainer member from the complementary groove.

3. The lock of claim 1 wherein the transverse peripheral groove extends in a plane that is transverse to the central axis and is of generally U-shape in that it includes a pair of generally parallel legs that are defined in portions of the plug located on opposites sides of the central axis, and has a relatively short reach that bridges between the parallel legs near adjacent end regions of the parallel legs.

4. The lock of claim 3 wherein the retaining member is a generally C-shaped clip that has a pair of opposed side portions that extend along said parallel legs, and that has a bridging central portion that is curved and connects with the opposed side portions, with the bridging central portion extending through the short reach of the transverse peripheral groove.

5. The lock of claim 4 wherein the opposed side portions carry barb-like stop formations that are engageable with a pair of opposed projecting stop formations that are defined along said parallel legs, with the cooperative engagement of the barb-like stop formations with the projecting stop formations serving to limit movement of the C-shaped clip out of the transverse peripheral groove.

6. The lock of claim 5 wherein the biasing means includes a pair of compression coil springs that extend along the parallel legs of the transverse peripheral groove and engage the C-shaped clip to bias the clip outwardly from the transverse peripheral groove for engagement with the complementary groove.

7. The lock of claim 6 wherein selected portions of the plug that define the parallel legs of the transverse peripheral groove extend closely alongside portions of the parallel legs of the C-shaped clip to guide the inward and outward movement of the clip relative to the plug.

8. The lock of claim 7 wherein a keyway is formed through central portions of the plug, and transverse peripheral groove extends around a significant portion of the keyway, with the opposed projecting stop formations being provided on opposite sides of the keyway.

9. The lock of claim 1 additional including structure that can be substituted for said plug, with said substitutable structure including a plug-like formation that is insertable into the chamber to the operating position in substitution for said plug, and that is rotatable relative to the barrel between at least said pair of angularly spaced positions, with the plug-like formation having its own transverse peripheral groove formed therein, with the plug-like formation having its own retaining member mounted in its transverse peripheral groove for projecting therefrom into said complementary groove when the plug-like formation is substituted for said plug, with the plug-like formation carrying its own biasing means for biasing its retaining member outwardly with respect to its transverse peripheral groove such that portions of its retaining member are caused to extend into said complementary groove when the plug-like formation is received at the operating position in substitution for the plug, and with the substitutable structure being removable from the barrel as by inserting a tool in the passage of substantially the same manner that is used to effect removal of the plug from the barrel.

10. The lock of claim 1 additional including a rotary electrical switch connect to the barrel and having a rotary operator that is drivingly connected to the plug when the plug is in the operating position.

11. A lock of the type comprising a plug having a transverse peripheral groove formed therein; a barrel having an outer surface with front portions thereof defining a ring-like rim that remains readily accessible when the barrel is installed on a suitably configured mount, a forwardly-facing opening that is surrounded by the rim, and an inner surface that extends rearwardly from the front opening to define a chamber within the barrel; with the chamber being configured to receive body portions of the plug and to position the plug at an operating position; with the plug being rotatable relative to the barrel between at least a pair of angularly spaced positions once the plug has been positioned at the operating position, with such rotation being about an imaginary central axis that extends forwardly through the center of the front opening and rearwardly through the chamber; a retaining member mounted in the transverse peripheral groove of the plug for projecting therefrom into a complementary groove that is formed in the inner surface at a location that is within close proximity to the rim; biasing means carried by the plug for biasing the retaining member outwardly with respect to the transverse peripheral groove such that portions of the retaining member are caused to extend into the complementary groove when the plug is received at the operating position within the barrel; a tool-receiving passage of relatively small cross section formed through the rim, with the passage 1) having an outer end that opens through the outer surface, 2) having an inner end that opens into the complementary groove, and 3) being oriented to permit insertion of a thin, elongated tool through the outer end and into engagement with the retaining member to move the retaining member in opposition to the biasing means to a plug-removal position wherein the retaining member is forced out of the complementary groove so that the plug can be removed from the barrel; with the transverse peripheral groove being oriented to extend in a plane that is transverse to the central axis, with the transverse peripheral groove being of generally U-shape in that it includes a pair of generally parallel legs that are defined within selected portions of the plug that are located on opposite sides of the central axis, and with the transverse peripheral groove having a relatively short reach that bridges between the parallel legs near adjacent end regions of the parallel legs; with the retaining member being a generally C-shaped clip that has a pair of opposed side portions that extend along said parallel legs, with the retaining member having a bridging central portion that is curved and connects with the opposed side portions, with the bridging central portion extending through the short reach of the transverse peripheral groove, with the opposed side portions carrying barb-like stop formations that are engageable with a pair of opposed projecting stop formations that are defined along said parallel legs; with the cooperative engagement of the barb-like stop formations with the projecting stop formations serving to limit movement of the C-shaped clip out of the transverse peripheral groove; with the biasing means including a pair of compression coil springs that extend along the parallel legs of the transverse peripheral groove for engaging the C-shaped clip to bias the clip outwardly from the transverse peripheral groove for engagement with the complementary groove; with the selected portions of the plug that define the parallel legs of the transverse peripheral groove extending closely alongside portions of the parallel legs of the C-shaped clip to guide the inward and outward movement of the clip relative to the plug; with a keyway being formed through central portions of the plug, and with the transverse peripheral groove extending around a significant portion of the keyway; with the opposed projecting stop formations being provided on opposite sides of the keyway; with the C-shaped clip being configured so that, when the C-shaped clip is nested within the transverse peripheral groove, it has three angularly spaced portions that have outer surfaces that conform quite closely in configuration to that of the outer diameter of an enlarged head portion of the plug within which the transverse peripheral groove is formed; and with the C-shaped clip being configured such that, when the C-shaped clip projects out of the transverse peripheral groove for engaging the complementary groove, the three angularly spaced portions all extend into the complementary groove so as to securely bridge between the transverse peripheral groove and the complementary groove so as to retain the plug in the barrel.

12. The lock of claim 11 wherein:

a) the barrel has inner surface formation means in communication with the chamber for defining a tumbler-receiving formation; and, b) the plug carries tumbler means for engaging the tumbler-receivable formation for locking the plug in at least a selected one of the pair of angularly spaced positions unless the plug is engaged by a suitably configured key that unlocks the plug for rotation relative to the barrel as by retracting the tumbler means from locking engagement with the tumbler-receivable formation.

13. The lock of claim 11 wherein the plug caries no key-operated tumblers and is capable, once it is duly positioned in the operating position, of being rotated between said pair of angular spaced positions without requiring the use of a key.

14. The lock of claim 11 wherein the inner surface defines a tumbler receiving formation at a location spaced rearwardly from the location of the transverse peripheral groove, and the plug carries tumbler means for engaging the tumbler receiving formation for locking the plug in at least a selected one of said pair of angularly spaced positions unless the plug is engaged by a suitably configured key that unlocks the plug for rotation relative to the barrel as by retracting the tumbler means from locking engagement with the tumbler receiving formation.

15. The lock of claim 14 wherein the tumbler receiving formation includes a pair of opposed first and second inner surface formations that are located on opposite sides of the interior of the chamber, the plug defines a keyway that extends generally along the central axis for receiving a double-bitted key, and the tumbler means includes a pair of opposed first and second tumblers that are located along the keyway and that are engageable with the opposed first and second inner surface formations for locking the plug in at least a selected one of the pair of angularly spaced positions unless a suitably configured double-bitted key is inserted along the keyway to retract the opposed first and second tumblers from locking engagement with the opposed first and second inner surface formations.

16. The lock of claim 15 wherein said suitably configured key has a pair of oppositely coordinated "primary" serratures that define major portions of the width of the key, and a "secondary" serrature that is of single-bitted character and extends along a central portion of the key at a location between the opposed "primary" serratures; and, the tumbler means includes a plurality of sets of opposed "primary" tumblers that are caused to be positively positioned by the "primary" serratures, and a plurality of "secondary" tumblers that are interleaved with the "primary" tumblers, with the "secondary" tumblers being positioned by the "secondary" serrature.

17. The lock of claim 11 wherein a second groove is defined by the inner surface at a location within the chamber that is spaced rearwardly from the location of the complementary groove, and the plug carries retention tumbler means for extending into the second groove to prevent removal of the plug from the barrel unless the plug is engaged by a suitably configured key that retracts the retention tumbler means from extending into the second groove, whereby the plug is locked against being removed from the barrel unless the plug is engaged by a suitably configured key.

18. The lock of claim 17 wherein the plug defines a keyway that extends generally along said central axis for receiving a double-bitted key, and the retention tumbler means includes at least a pair of opposed first and second retention tumblers that are located along the keyway and that are engageable with opposite sides of the second groove for preventing removal of the plug from the barrel unless a suitably configured double-bitted key is inserted along the keyway to retract at least the opposed first and second retention tumblers from extending into the second groove.

19. The lock of claim 11 wherein the inner surface of the barrel defines first and second tumbler receiving formations, the inner surface also defines a ring-like formation that extends into the chamber at a location that is between the first and second tumbler receiving formations, first tumbler means are carried by the plug for extending into the first tumbler receiving formation for locking the plug in at least a selected one of said pair of angularly spaced positions unless the plug is engaged by a suitably configured key that unlocks the plug for rotation relative to the barrel as by retracting the first tumbler means from extending into the first tumbler receiving formation, and second tumbler means is carried by the plug for extending into the second tumbler receiving formation for locking the plug against being removed from the barrel unless the plug is engaged by a suitably configured key that unlocks the plug for removal from the barrel as by retracting the second tumbler means from extending in the second tumbler receiving formation.

20. The lock of claim 19 wherein the first tumbler receiving formation is located relatively near the front of the chamber, the second tumbler receiving formation is located behind the first tumbler receiving formation, the plug has a tumbler compartment that extends along the central axis from a front position that overlies the first tumbler receiving formation to a rearward position that overlies the second tumbler receiving formation, with the tumbler compartment also having a relatively centrally located portion that overlies said ring formation, with the first tumbler means being carried within the front position, with the second tumbler means being carried within the rearward position, and with non-operating tumblers filling spaces between the front and rear positions so as to overlie the ring formation.

21. The lock of claim 11 wherein the plug caries no key-operated tumblers and is capable, once it is duly positioned in the operating position, of being rotated between said pair of angularly spaced positions without requiring the use of a key.

22. The lock of claim 12 wherein:

a) the inner surface formation means includes a pair of opposed first and second inner surface formations located on opposite sides of the chamber;

b) the plug defines a keyway that extends generally along said central axis for receiving a double-bitted key; and, c) the tumbler means includes at least a pair of opposed first and second tumblers that are located along the keyway and that are engageable with the opposed first and second inner surface formations for locking the plug in at least a selected one of the pair of angularly spaced positions unless a suitably configured double-bitted key is inserted along the keyway to retract at least the opposed first and second tumblers from locking engagement with the opposed first and second inner surface formations.

23. The lock of claim 12 wherein:

a) the plug defines a keyway that extends generally along said central axis for receiving a double-bitted key; and, b) the tumbler means includes at least a pair of opposed first and second tumblers that are located along the keyway and that are engageable with the tumbler-receiving formation for preventing removal of the plug from the barrel unless a suitably configured double-bitted key is inserted along the keyway to retract at least the opposed first and second tumblers from extending into engagement with the tumbler-receiving formation.

24. The lock of claim 11 wherein:

a) the barrel has inner surface formation means in communication with the chamber for defining first and second tumbler-receivable formation means that rae separated one from another by a ring-like formation that extends into the chamber in a plane that is transverse to the central axis;

b) the plug carries tumbler mean including:

i) first tumbler means for being received by the first tumbler-receivable formation means for locking the plug in at least a selected one of the pair of angularly spaced positions unless the plug is engaged by a suitably configured key that unlocks the plug for rotation relative to the barrel as by retracting the first tumbler means from locking engagement with the first tumbler-receivable formation means; and, i) second tumbler means for being received by the second tumbler-receivable formation means for locking the plug against being removed from the barrel unless the plug is engaged by a suitably configured key that unlocks the plug for removal from the barrel as by retracting the second tumbler means from extending into the second tumbler-receivable formation means.

25. The lock of claim 11 additionally including a rotary electrical switch connected to the barrel and having a rotary operator that is drivingly connected to the plug when the plug is in the operating position.

26. A lock having substitutable plug-type operator assemblies, comprising:

a) barrel means including a generally cylindrical barrel for being mounted on suitable support structure, and for defining a generally cylindrical chamber that extends forwardly and rearwardly along an imaginary center axis that extends forwardly and rearwardly through the generally cylindrical barrel, and wherein:

i) the barrel has opposed front and rear end regions that are interconnected by a generally cylindrical central region, with the front end region, the central region and the rear end region of the barrel being arranged substantially concentrically about the central axis;

ii) the chamber has opposed front and rear end portions that are interconnected by a generally cylindrical central portion, with the front end portion, the central portion and rear end portion of the chamber being arranged substantially concentrically about the central axis, and with the chamber being configured to receive body portions of a selected one of a pair of substitutable plug-type operator assemblies so as to substitutably position the selected plug-type operator assembly at a operating position;

iii) rim means including a rim formation is defined by the front end region of the barrel, with the rim formation having a front opening of generally circular shape that extends substantially concentrically about the center axis and opens into the front end proton of the chamber, with the rim formation defining rearwardly facing mounting formation means at a location spaced rearwardly from the front opening for engaging said suitable support structure, and with the rim means having outer surface means including an outer surface that extends between the front opening and the mounting formation and for defining a surface area that remains readily accessible even after the barrel has been mounted on said suitable support structure;

iv) inwardly facing surface means is defined by the front end region of the barrel including a generally cylindrical inner surface that extends rearwardly along the central axis from the front opening for defining the front portion of the chamber;

b) plug-type operator means including first and second plug-type operator assemblies that each have body portions that are configured to be substantially inserted into the chamber as by moving the body portions rearwardly through the front opening and along the central axis to enable a selected one of the substitutable first and second operator assemblies at said operating position, and wherein:

i) the body portions of each of the plug-type operator assemblies are configured to permit the associated operator assembly to be rotated about the central axis between first and second angularly spaced positions once the associated operator assembly has been duly positioned at the operating position;

ii) the body portions of each of the plug-type operator assemblies defines connecting formation means for being drivingly connected to a suitably configured operator formation of a lockable device so as to cause the operator formation to be moved in response to said rotary movement of a duly positioned one of the operator assemblies;

iii) the body portions of each of the plug-type operator assemblies define front formation means including a generally cylindrical head that is configured to reside within the front end portion of the chamber when the associated operator assembly has been duly positioned at the operating position; and, c) retaining means are provided for releasably retaining each of the plug-type operator assemblies in the operating position once it has been duly positioned at the operating position, including:

i) first groove means formed in the inner surface of the barrel at a location spaced rearwardly from the front opening;

ii) complementary groove means including first and second separate groove formations provided in the peripheries of the generally cylindrical head formations of the first and second operator assemblies, respectively, with one of the groove formations being brought into alignment with the first groove means whenever an associated one of the operator assemblies has been duly positioned at the opening position;

iii) retainer means for being positioned within the complementary groove means and for bridging between the complementary groove means and the first groove means of an operator assembly that has been duly positioned at the operating position, with the retainer means including a first and second retainer member connected to the first and second plug-type operator assemblies, respectively, with each such retainer member having portions thereof that extend into the groove formation of the associated operator assembly, and that extend into retaining engagement with selected portions of the associated operator assembly so as to beheld connected to the associated operator assembly even when the associated operator assembly has its body portions removed from the chambers of the barrel; and iv) biasing means including a separate biasing element connected to each of the first and second plug-type operator assemblies for biasing the associated retainer member toward a position of bridging engagement with the first groove means when the associated operator assembly has been duly positioned at the operating position;

d) retainer releasing means including a passage that is defined by the front end region of the barrel, with the passage being of relatively small cross section in comparison with the size of the front opening, with the passage having an outer end that opens outwardly through said accessible surface area, with the passage having an inner end that communicates with the chamber, and with the passage being oriented such that, when either of the first and second plug-type operator assemblies 1) is duly positioned at the operating position and 2) is rotated relatively to the barrel to said first angular position, the associated retainer member is positioned near the inner end of the passage such that an elongate tool inserted loosely through the passage will engage the associated retainer member and permit the associated retainer member to be moved in opposition to the biasing action of the associated biasing element to move the associated retainer member out of the first groove means so that the duly positioned operator assembly can be withdrawn from the barrel as by removing its body portions through the front opening of the barrel;

e) the barrel defines second groove means that opens into the chamber at a location that is spaced rearwardly from the first groove means;

f) at least a selected one of said plug-type operator assemblies carries retention tumbler means for extending into the second groove means unless said one plug-type operator assembly is engaged by a suitably configured key that retracts the tumbler means from extending into the second groove means, whereby said one plug-type operator assembly is locked against being removed from the barrel unless being so engaged by a suitably configured key; and, g) the second groove means extends within a plane that is transverse relative to the central axis, and is configured to permit rotation of said one plug-type operator assembly relative to the barrel between the first and second angularly spaced positions while said tumbler means remains engaged with said second groove means.

27. The lock of claim 26, wherein:

a) each of said generally cylindrical head formations that reside within the front end portion of the chamber when the associated operator assembly has been duly positioned at the operating position is of relatively larger diameter than are such other portions of the body as extend rearwardly from the head formations, and each such head formation has a transversely extending shoulder that defines a transition between the associated relatively larger diameter head formation and such other portions of the body as extend rearwardly therefrom; and, b) a notch is formed in each of the head formations at a location extending forwardly from the associated shoulder and extending into the associated groove formation to remove material of the head formation that otherwise might come into engagement with a tool that is inserted through said passage to remove the associated retainer member from the first groove means.

28. The lock of claim 26 additionally including rotary electrical switch means connected to the barrel and having rotary operator means including an operator formation that is configured to drivingly engage the connecting formation means of each of the plug-type operator assemblies when duly positioned in the operating position, with the rotary operator means serving to operate the rotary electrical switch means in response to rotation of a duly positioned operator assembly between said first and second angularly spaced positions.

29. The lock as claimed in claim 13, 14, 15, 16, 17, 18, 19, 20, 2, 3, 4, 5, 6, 7 or 8 additionally including a rotary electrical switch connected to the barrel and having a rotary operator that is drivingly connected to the plug when the plug is in the operating position.

30. The lock as claimed in claim 26, 21, 12, 22, 23, 24 or 27 additionally including rotary electrical switch means connected to the barrel and having rotary operator means including an operator formation that is configured to drivingly engage the connecting formation means of each of the plug-type operator assemblies when duly positioned in the operating position, with the rotary operator means serving to operate the rotary electrical switch means in response to rotation of a duly positioned operator assembly between said first and second angularly spaced positions.

* * * * *